US007165329B2

(12) United States Patent
Kao

(10) Patent No.: US 7,165,329 B2
(45) Date of Patent: Jan. 23, 2007

(54) FOLDING KNIFE WITH SAFETY DEVICE

(76) Inventor: Chih-Chen Kao, No. 109, Jhonghua Rd., Taoyuan City, Taoyuan County (TW)

( * ) Notice: Subject to any disclaimer, the term of this patent is extended or adjusted under 35 U.S.C. 154(b) by 15 days.

(21) Appl. No.: 11/068,976

(22) Filed: Mar. 2, 2005

(65) Prior Publication Data

US 2006/0162168 A1 Jul. 27, 2006

(30) Foreign Application Priority Data

Jan. 21, 2005 (TW) ..... 94201139 U

(51) Int. Cl.
*B26B 1/04* (2006.01)

(52) U.S. Cl. ..... 30/161; 30/160

(58) Field of Classification Search ..... 30/161, 30/160, 331

See application file for complete search history.

(56) References Cited

U.S. PATENT DOCUMENTS 5,737,841 A * 4/1998 McHenry et al. ..... 30/161
6,256,888 B1 * 7/2001 Shuen ..... 30/161
6,826,836 B1 * 12/2004 Lin ..... 30/161
2005/0183268 A1 * 8/2005 Chen ..... 30/161
2005/0229401 A1 * 10/2005 Onion ..... 30/161

* cited by examiner

*Primary Examiner*—Charles Goodman
(74) *Attorney, Agent, or Firm*—Bacon & Thomas

(57) ABSTRACT

The present invention is to provide a folding knife comprising a flat member within a handle thereof, the flat member comprising a latch having an open end proximate a pivot pin of a blade on the handle, the latch including a projection on its one surface, the projection being adapted to be pressed by a sliding block so as to allow the latch to exert a downward force onto the blade wherein a sliding movement of the slide is adapted to cause the sliding block to compress a resilient member toward a rear end of the handle for disengaging the sliding block from the projection and for pivoting the blade either out of or into the groove.

6 Claims, 5 Drawing Sheets

FOLDING KNIFE WITH SAFETY DEVICE

FIELD OF THE INVENTION

The present invention relates to folding tools, more particularly to a folding knife having a safety device to prevent the cutting edge from hurting the finger when the blade is pivoting to retract into a groove in the handle.

BACKGROUND OF THE INVENTION

Typically, a police officer, parachutist, fire fighter, or rescuer may carry a special knife for being ready for all emergencies. Such knives are popular among police officers and soldiers and have become ubiquitous tools for them due to its excellent performance. Nowadays, more and more people spend time in leisure activities such as mountaineering, camping, or diving. And in turn, knives such as folding knives are commercially available for meeting the needs. One type of folding knife is characterized in that it can be operated by one hand. In case of emergency, a user may quickly unfold the blade from the handle of the folding knife. For example, a diver may use one hand to quickly unfold the blade from the handle of the folding knife if unfortunately the other hand is tangled by fishing-net, rope, or safety belt during diving. Next, the diver may cut the fishing-net, rope, or safety belt by means of the cutting edge of the blade. As a result, life of the diver can be saved.

While such folding knife is characterized in that the blade can be quickly unfolded or folded by means of one hand, however, it lacks of safety due to its disadvantageous construction. For example, the finger of a user may be hurt by the cutting edge of the pivoting blade when the blade is folding into a groove in the handle. In a worse condition, the finger may be completely cut off. Thus, folding knife manufacturers must spend time in developing a highly safe folding knife as improvement. Following is a detailed description of the prior folding knife.

Referring to FIG. 1, the folding knife 1 comprises a handle 10 and a blade 20. The handle 10 comprises a groove 11 open to its lower side. The groove 11 is adapted to receive the folded blade 20. The blade 20 comprises a point 21 at one end, a pivot 22 at the other end, and a pivot pin 23 in the pivot 22 for pivotably disposing the pivot 22 at one end of the groove 11 in the handle 10. The blade 20 is adapted to receive in the groove 11 by pivoting the pivot 22 about the pivot pin 23. Alternatively, move a slide 24 on the blade 20 to cause the blade 20 to pivot out of the groove 11. Such pivoting will be stopped by a stopper 25 in the handle 10 proximate the pivot pin 23 for preventing the blade 20 from pivoting out of its predetermined limit. In FIG. 1, the handle 10 comprises two identical plates coupled together by a small flat block 12 so as to form a gap (i.e., the groove 11) therebetween.

Moreover, a flat piece 13 is formed on a side of one plate adjacent the groove 11 in the handle 10. The piece 13 has one end extended from the pivot pin 23 toward the other end so as to form an elongate trough 14. A bent resilient member 15 is thus formed by the trough 14 and extended from one end of the piece 13 at the pivot pin 23. The resilient member 15 is adapted to bear against an outer surface of the pivot 22 of the blade 20 externally of the groove 11 (see FIG. 1).

Referring to FIG. 2, for retracting the blade 20 into the groove 11, a user has to press and flatten the resilient member 15 by means of the finger so as to disengage it from the outer surface of the pivot 22 of the blade 20. Next, pivot the back of the blade 20 to fold the blade 20 into the groove 11. However, the finger pressing the resilient member 15 (as indicated by arrow in FIG. 2) may be cut by the cutting edge of the retracting blade 20. To the worse, the finger may be completely cut off in an extreme condition. In brief, the folding knife 1 is not a safe device.

Thus, it is desirable to provide a novel folding knife having advantages of being capable of easily, quickly folding or unfolding by one hand, being easy in carrying, and being highly safe when the blade is pivoting to retract into the handle, thereby contributing significantly to the advancement of the art.

SUMMARY OF THE INVENTION

After considerable research and experimentation, a folding knife having a safety device according to the present invention has been devised so as to overcome the above drawback of the prior art. The drawback is that for retracting the blade into the handle, a user has to use the finger to press and flatten the bent resilient member prior to pivoting the blade into a closed position. However, the finger is susceptible of being cut by the cutting edge since the finger is approaching the cutting edge in the closing operation.

It is an object of the present invention to provide a folding knife having the advantages of being capable of easily, quickly folding or unfolding the blade by one hand, and being highly safe when the blade is pivoting. The folding knife comprises a blade, a handle comprising a groove open to a lower side, a sliding block and a resilient member having the other end anchored at the sliding block wherein both the sliding block and the resilient member are provided on an inner surface of the handle, a slide on an outer surface of the handle above the sliding block, a flat member within the handle under the sliding block and the resilient member, the flat member comprising a latch having an open end proximate the pivot pin, the latch including a projection on its one surface, the projection being adapted to be pressed by the sliding block so as to allow the latch to exert a downward force onto the blade wherein a sliding movement of the slide is adapted to cause the sliding block to compress the resilient member toward a rear end of the handle for disengaging the sliding block from the projection and for pivoting the blade either out of or into the groove, and a release of the compression is adapted to cause the resilient member to push the sliding block forwardly for causing the latch to either obliquely urge against an outer surface of the pivot when the blade is pivoted out of the groove or bear against the outer surface of the pivot when the blade is pivoted into the groove. By utilizing this folding knife, it is thus ensured that the cutting edge of the blade will not cut the finger of the user when the blade is pivoting to retract into the groove and thus a safe folding knife is realized.

The above and other objects, features and advantages of the present invention will become apparent from the following detailed description taken with the accompanying drawings.

DETAILED DESCRIPTION OF THE PREFERRED EMBODIMENTS

Figure 1:
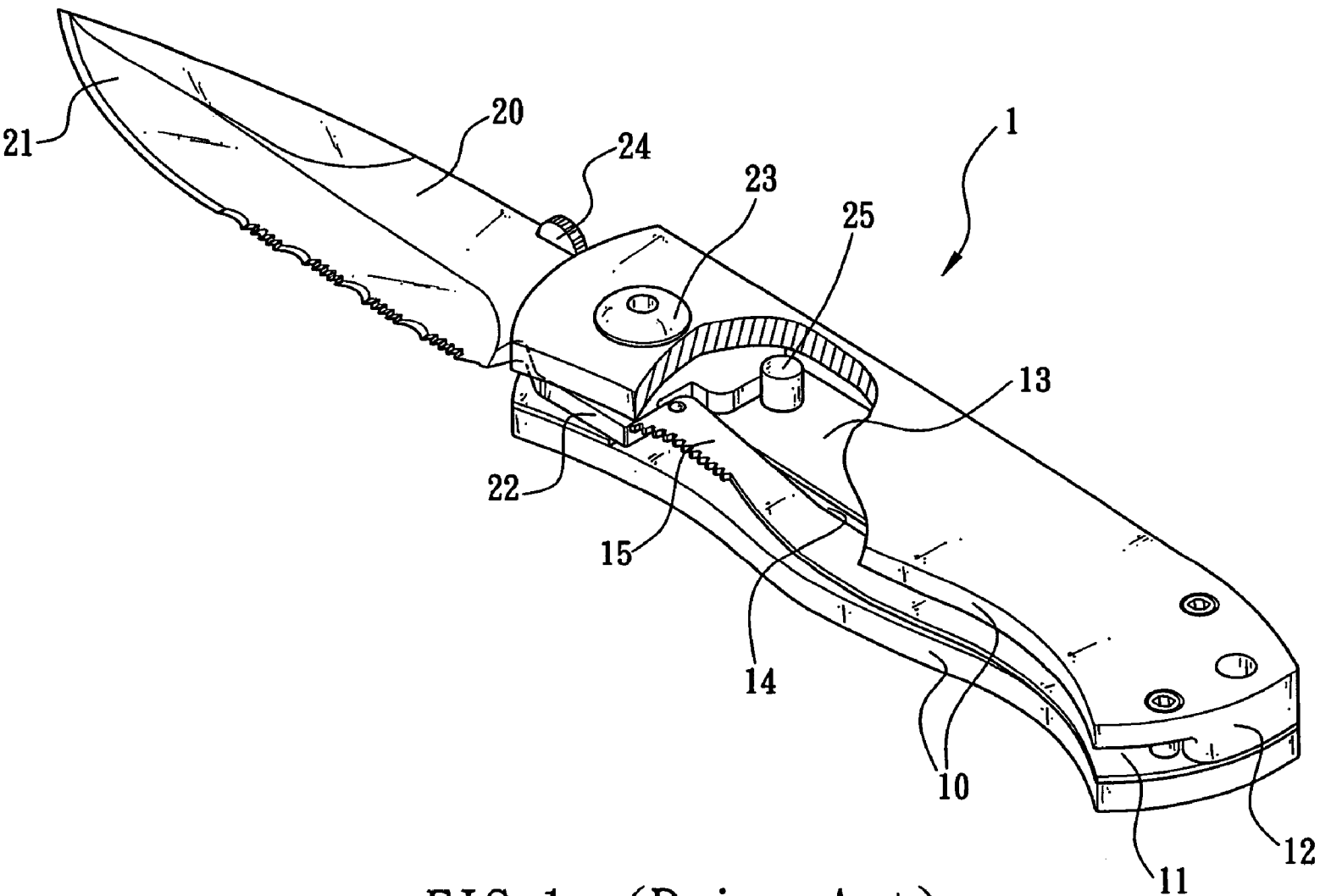
FIG. 1 (Prior Art)
FIG. 1 is a perspective view of a conventional folding knife with the handle partially broken away and the blade unfolded for being ready for use.
Figure 2:
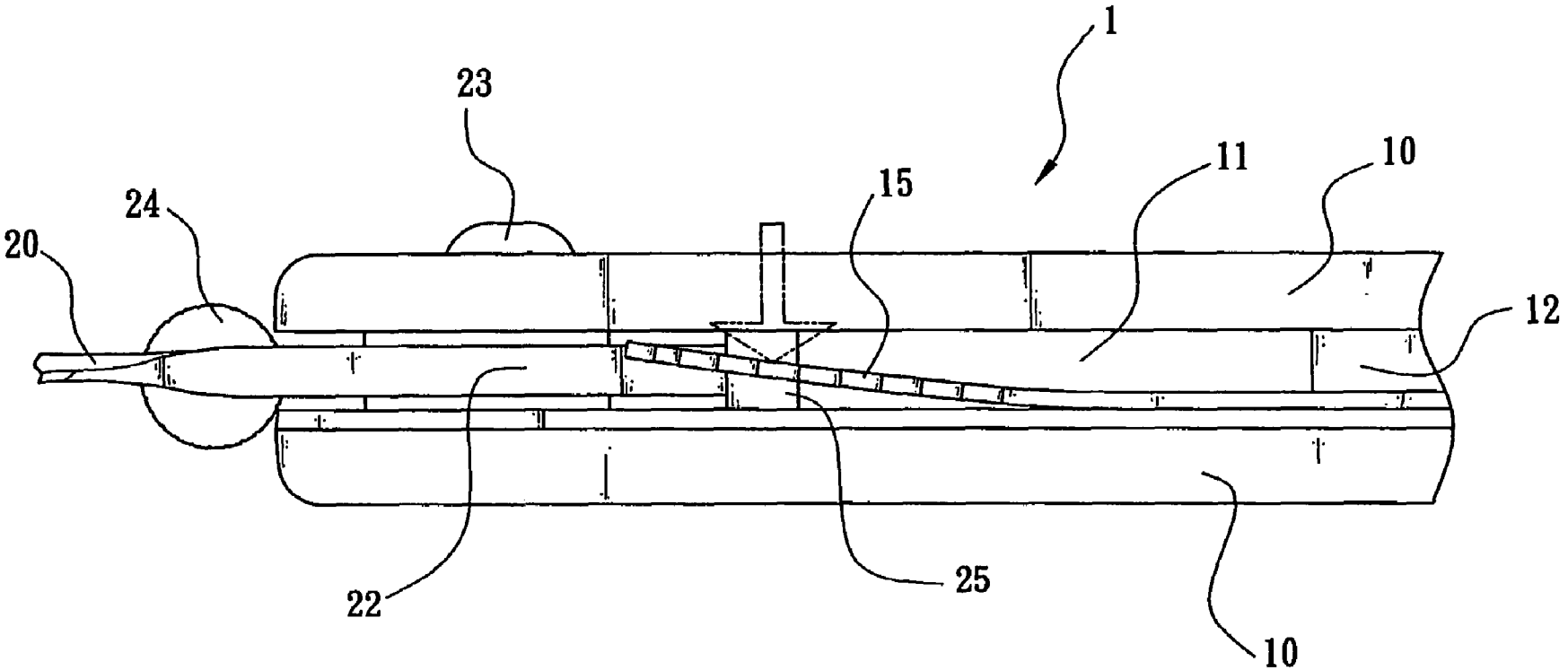
FIG. 2 (Prior Art)
FIG. 2 is a side view of the folding knife of FIG. 1 showing a pressing of the resilient member prior to folding the blade into the handle.
Figure 3:
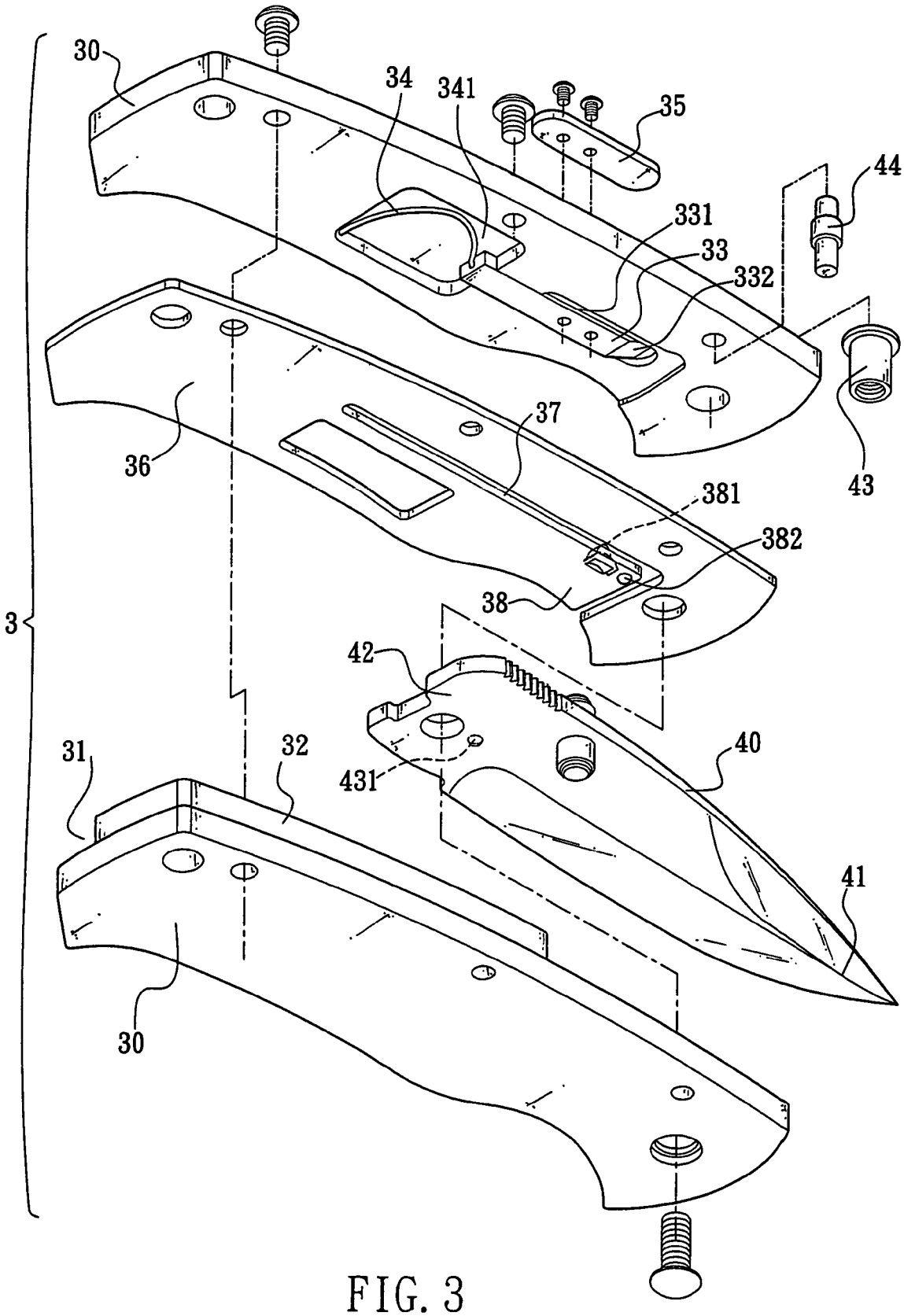
FIG. 3 is an exploded view of a preferred embodiment of folding knife according to the invention.

Referring to FIG. 3, there is shown a folding knife 3 according to a preferred embodiment of the invention. The folding knife 3 comprises a handle 30 and a blade 40. The handle 30 comprises a groove 31 open to its lower side. The groove 31 is adapted to receive the folded blade 40. The blade 40 comprises a point 41 at one end, a pivot 42 at the other end, and a pivot pin 43 in the pivot 42 for pivotably disposing the pivot 42 at one end of the groove 31 in the handle 30. The blade 40 is adapted to receive in the groove 31 by pivoting the pivot 42 about the pivot pin 43. Alternatively, pivot the blade 20 out of the groove 31 until being stopped by a stopping rod 44 proximate the pivot pin 43 for preventing the blade 40 from pivoting out of its predetermined limit. In FIG. 3, the handle 30 comprises two identical plates coupled together by a small flat block 32 so as to form a gap (i.e., the groove 31) therebetween.

Referring to FIG. 3 again, in the invention on an inner surface of one plate of the handle 30 there are provided an elongate trough 331 and a rectangular recess 341 in communication therewith. An elongate sliding block 33 and a bent resilient member (e.g., spring) 34 are provided in the trough 331 and the recess 341 respectively. The other end of the resilient member 34 is anchored at one end of the sliding block 33. A slide 35 is provided on an outer surface of the handle 30 above the sliding block 33. A sliding movement of the slide 35 may cause the sliding block 33 to compress the resilient member 34 toward a rear end of the handle 30. A release of the compression will cause the resilient member 34 to push the sliding block 33 toward a forward end of the handle 30.

Figure 4:
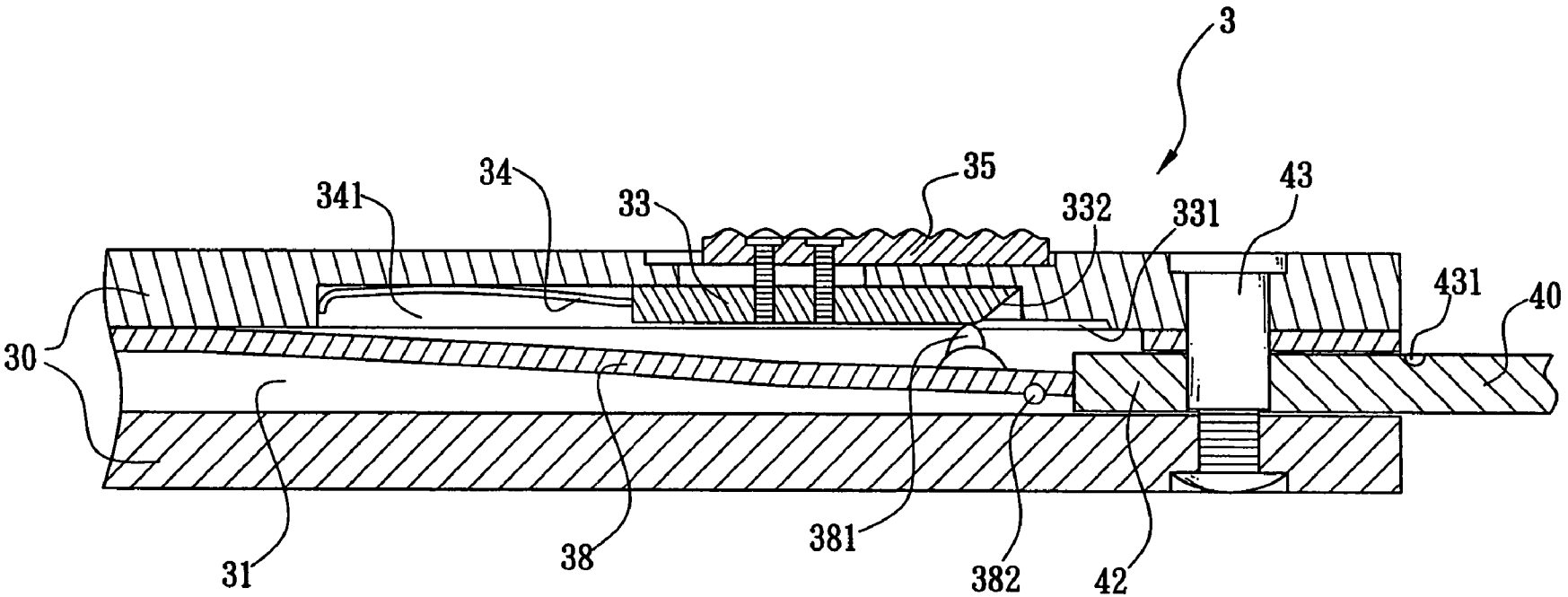
FIG. 4 is a sectional view of the assembled folding knife of FIG. 3 with the blade unfolded for being ready for use.
Figure 5:
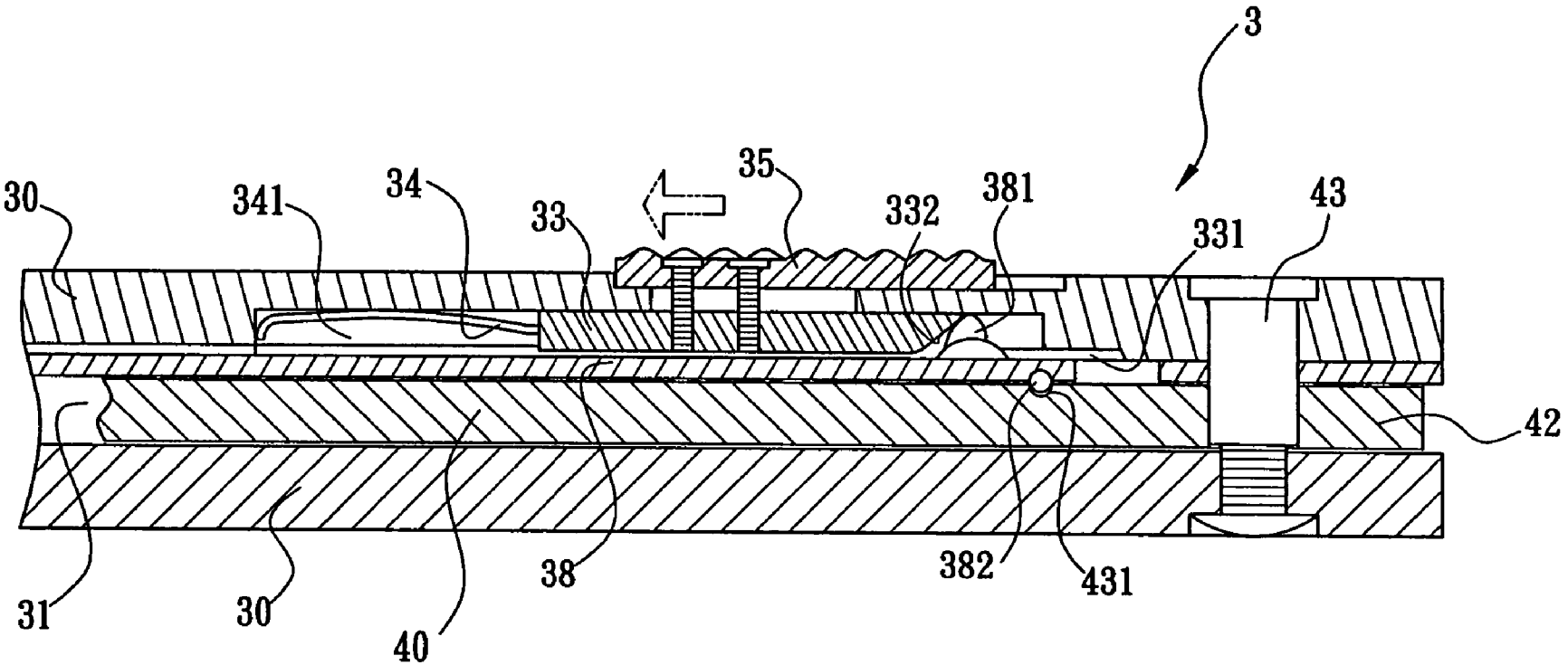
FIG. 5 is a view similar to FIG. 4 showing a folding operation of the blade.

Also, a flat member 36 is provided within the handle 30 under the sliding block 33 and the resilient member 34. The other end of the flat member 36 is pivotably secured to the pivot pin 43. An L-shaped slot 37 has its shorter portion proximate the other end of the flat member 36 and has its longer portion extended toward one end of the flat member 36. A latch 38 is thus formed on the flat member 36 and is defined by the slot 37. The latch 38 has its open end proximate the pivot pin 43. A projection 381 is formed proximate the open end of the latch 38 and is adapted to be pressed by the sliding block 33 in its sliding operation. The latch 38 is thus able to exert a downward force onto the blade 40. Referring to FIG. 4, in a case of the blade 40 pivoted out of the groove 31, the latch 38 is obliquely urged against an outer surface of the pivot 42 of the blade 40 due to the pressing of the sliding block 33 onto the latch 38. Referring to FIG. 5, a sliding movement of the slide 35 may disengage the sliding block 33 from the projection 381 so as to cause the latch 38 to return to its original flat shape. As a result, the blade 40 is able to pivot into the groove 31 (i.e., in a closed position).

By configuring as above, it is understood that for using the blade 40 received in the folding knife 3 (see FIG. 5), a user may slide the slide 35 to cause the sliding block 33 to slide the same. Accordingly, the sliding block 33 is disengaged from the projection 381 of the latch 38. Next, pivot the blade 40 out of the groove 31. At this position, the sliding block 33 presses the projection 381 of the latch 38 again due to the expansion of the resilient member 34 and the latch 38 is thus obliquely urged against the outer surface of the pivot 42 of the blade 40 (see FIG. 4). To the contrary, for folding the blade 40 simply slide the slide 35 rearwards as indicated by arrow in FIG. 5 to cause the sliding block 33 to slide the same. Accordingly, the sliding block 33 is disengaged from the projection 381 of the latch 38. Next, pivot the blade 40 into the groove 31. Note that the folding or unfolding of the blade 40 is carried out by sliding the slide 35 and which is disposed on the outer surface of the handle 30. It is thus ensured that the cutting edge of the blade 40 will not cut the finger of the user when the blade 40 is pivoting to retract into the groove 31. As a result, safety is greatly improved when the folding knife 3 is operated by one hand.

Referring to FIGS. 3, 4, and 5 again, in the embodiment of the invention an additional dimple 431 is provided on the blade 40 proximate the pivot pin 43. The provision of the dimple 431 can prevent the received blade 40 from pivoting out of the groove 31 of handle 30 to cause injury to the hand while carrying the folding knife 3. In detail, the dimple 431 is adapted to receive a protrusion 382 formed on a surface opposing the projection 381 but proximate the projection 381 when the blade 40 has received in the groove 31. By matingly engaging the protrusion 382 of the latch 38 with the dimple 431, the blade 40 is prevented from pivoting out the groove 31 when the blade 40 is urged by the latch 38. Moreover, for facilitating the sliding of the slide 35, a slanting surface 332 is formed at the other end of the sliding block 33 for pressing the projection 381 of the latch 38 in the sliding movement of the sliding block 33. The shape of the slanting surface 332 may be altered in other embodiments.

In brief, the folding knife 3 has the following advantages including being capable of easily, quickly folding or unfolding the blade 40 by one hand, and being highly safe when the blade 40 is pivoting, thereby contributing significantly to the advancement of the art.

While the invention herein disclosed has been described by means of specific embodiments, numerous modifications and variations could be made thereto by those skilled in the art without departing from the scope and spirit of the invention set forth in the claims.

What is claimed is:

1. A folding knife comprising:

a blade comprising a point at one end and a pivot at the other end;

a handle comprising a groove open to a lower side, the groove being adapted to receive the folded blade wherein the pivot includes a pivot pin for pivotably disposing the pivot at one end of the groove, and the blade is adapted to either receive in the groove by pivoting in a first direction about the pivot pin or pivot out of the groove by pivoting in a second opposing direction about the pivot;

a sliding block and a resilient member having the other end anchored at the sliding block wherein both the sliding block and the resilient member are provided on an inner surface of the handle;

a slide on an outer surface of the handle above the sliding block wherein a sliding movement of the slide is adapted to cause the sliding block to compress the resilient member toward a rear end of the handle, and a release of the compression is adapted to cause the resilient member to push the sliding block forwardly, and a flat member within the handle under the sliding block and the resilient member, the flat member comprising a latch having an open end proximate the pivot pin, the latch including a projection on its one surface, the projection being adapted to be pressed by the sliding block so as to allow the latch to exert a downward force onto the blade wherein responsive to pivoting the blade out of the groove, the latch is obliquely urged against an outer surface of the pivot of the blade by the pressing the sliding block onto the latch, and responsive to sliding the slide, the sliding block disengages from the projection for causing the latch to return to its original flat shape, thereby enabling the blade to pivot into the groove.

2. The folding knife of claim 1, further comprising a trough and a rectangular recess on the inner surface of the handle for receiving the sliding block and the resilient member respectively.

3. The folding knife of claim 1, wherein the flat member further comprises an L-shaped slot having a shorter portion proximate the pivot pin and a longer portion extended toward one end of the flat member for forming the latch.

4. The folding knife of claim 1, further comprising a dimple on the blade proximate the pivot pin and a protrusion on the other surface of the latch opposing the projection, wherein of the dimple is adapted to prevent the blade from pivoting out of the groove when the blade received in the groove is presses by the latch.

5. The folding knife of claim 1, wherein the handle comprises two identical, spaced plates and a flat block for coupling the plates together and for forming a gap therebetween as the groove.

6. The folding knife of claim 1, further comprising a slanting surface at the other end of the sliding block for pressing the projection of the latch.

* * * * *